US006910643B2

(12) United States Patent
Dantes et al.

(10) Patent No.: US 6,910,643 B2
(45) Date of Patent: Jun. 28, 2005

(54) FUEL INJECTION VALVE

(75) Inventors: Günter Dantes, Eberdingen (DE); Detlef Nowak, Untergruppenbach (DE)

(73) Assignee: Robert Bosch GmbH, Stuttgart (DE)

( * ) Notice: Subject to any disclaimer, the term of this patent is extended or adjusted under 35 U.S.C. 154(b) by 168 days.

(21) Appl. No.: 10/333,490

(22) PCT Filed: Apr. 24, 2002

(86) PCT No.: PCT/DE02/01500

§ 371 (c)(1),
(2), (4) Date: Jul. 10, 2003

(87) PCT Pub. No.: WO02/092995

PCT Pub. Date: Nov. 21, 2002

(65) Prior Publication Data

US 2004/0011897 A1 Jan. 22, 2004

(30) Foreign Application Priority Data

May 16, 2001 (DE) ..... 101 23 850

(51) Int. Cl.[7] ..... B05B 1/30; F02M 59/00; F02M 39/00

(52) U.S. Cl. ..... 239/585.1; 239/585.3; 239/585.4; 239/533.2; 239/533.3

(58) Field of Search ..... 239/585.1–585.5, 239/533.2, 533.3, 533.9, 88–93, 533.11, 533.14; 251/129.15, 129.21, 127

(56) References Cited

U.S. PATENT DOCUMENTS

| | | | | | |
|---|---|---|---|---|---|
| 5,544,816 | A | * | 8/1996 | Nally et al. | 239/585.5 |
| 5,921,475 | A | * | 7/1999 | DeVriese et al. | 239/585.4 |
| 5,979,803 | A | | 11/1999 | Peters et al. | |
| 5,996,911 | A | * | 12/1999 | Gesk et al. | 239/585.1 |
| 6,056,214 | A | | 5/2000 | DeGrace | |
| 6,257,496 | B1 | * | 7/2001 | Wyant | 239/5 |

FOREIGN PATENT DOCUMENTS

| | | |
|---|---|---|
| DE | 44 04 050 | 12/1994 |
| DE | 195 46 033 | 6/1997 |
| DE | 196 26 576 | 1/1998 |
| GB | 2 010 963 | 7/1979 |

* cited by examiner

*Primary Examiner*—Davis Hwu
(74) *Attorney, Agent, or Firm*—Kenyon & Kenyon

(57) ABSTRACT

A fuel injector (1) is provided with a magnetic coil (10), which cooperates with an armature (20) acted upon by a restoring spring (23), the armature forming an axially movable valve part together with a valve needle (3). A valve-closure member (4), which forms a sealing seat with a valve-seat member (5), is provided at the valve needle (3). A flange (14), which penetrates the armature (20) through an opening (19) of the armature (20) and which is connected to the valve needle (3) by force-locking, has at least one radial fuel channel (11) with whose aid an inner chamber (29) of the fuel injector (1) is able to be connected to a recess (22) of the valve needle (3) upon actuation of the fuel injector (1).

11 Claims, 2 Drawing Sheets

FUEL INJECTION VALVE

FIELD OF THE INVENTION

The present invention related to a fuel injector.

BACKGROUND INFORMATION

As an example, from German Published Patent Application No. DE 196 26 576 an electromagnetically actuable fuel injector is known, in which, for the electromagnetic actuation, an armature cooperates with an electrically energizable magnetic coil, and the lift of the armature is transmitted to a valve-closure member via a valve needle. The valve-closure member cooperates with a valve-seat surface to form a sealing seat. A plurality of fuel channels is provided in the armature. The armature is reset by a resetting spring.

Disadvantageous in the fuel injector known from German Published Patent Application No. DE 196 26 576 is, in particular, that the fuel quantity $q_{dyn}$ flowing through the fuel injector cannot be metered with sufficient precision when the valve-closure member lifts off from the sealing seat. The ratio of maximally sprayed-off fuel quantity relative to minimally sprayed-off fuel quantity, $q_{max}/q_{min}$, is relatively low. The characteristic curve of the fuel injector, which represents the profile of the dynamic flow rate $q_{dyn}$ as a function of the valve needle lift, is relatively flat, so that considerable fluctuations occur in the dynamic flow rate.

SUMMARY OF THE INVENTION

In contrast, the fuel injector according to the present invention has the advantage over the related art that at least one fuel channel is disposed in the valve interior in such a way that its cross section is closed off when the fuel injector is closed, so that the interior of the fuel injector is not connected to the opening of the valve needle. When the fuel injector opens, the fuel channel is released, thereby obtaining an approximately stepped characteristic curve.

It is advantageous, in particular, that the at least one fuel channel is formed in a flange that penetrates the armature of the magnetic circuit and is frictionally connected to the valve needle. This simple design eliminates a costly design for the armature's free path.

It is also advantageous that the fuel channel is covered by an appropriately formed shoulder of the inner pole of the fuel injector, thereby dispensing with additional components.

Also advantageous, in particular, is the tubular valve needle whose orifice allows both the plug connection with the flange and also a conveying of the fuel.

Moreover, it is advantageous that the at least one fuel channel is dimensioned such that it does not act as a throttle, so that no lift throttling takes place.

DETAILED DESCRIPTION

Figure 1A:
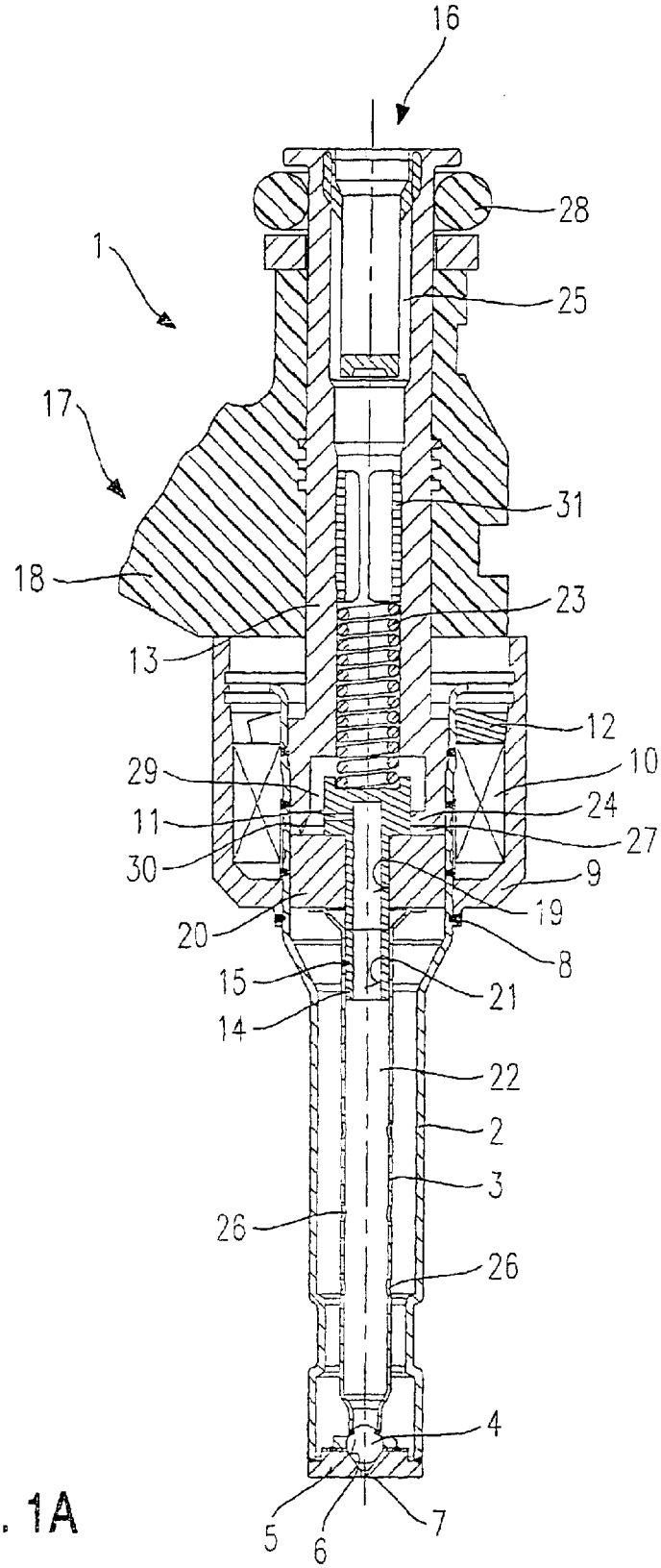
FIG. 1A shows a schematic section through an exemplary embodiment of a fuel injector designed according to the present invention, in the closed state.
Figure 1B:
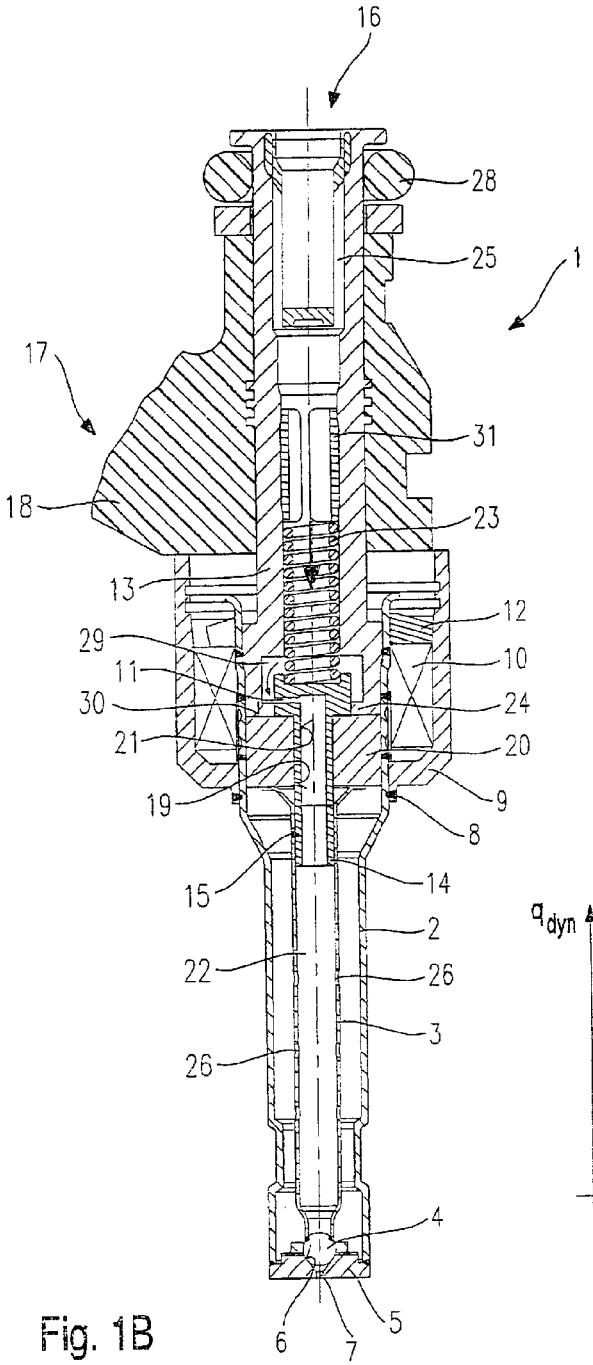
FIG. 1B shows a schematic section through an exemplary embodiment of a fuel injector designed according to the present invention, in the open state.

FIGS. 1A and 1B show a part-sectional view of an exemplary embodiment of fuel injector 1, designed according to the present invention, in the closed state. It is designed in the form of a fuel injector 1 for fuel injection systems of mixture-compressing internal combustion engines with externally supplied ignition. Fuel injector 1 is suited for the direct injection of fuel into a combustion chamber (not shown) of an internal combustion engine.

Fuel injector 1 is made up of a tubular nozzle body 2 in which a valve needle 3 is positioned. Valve needle 3 is in operative connection with a valve-closure member 4, which cooperates with a valve-seat surface 6 disposed on a valve-seat member 5 to form a sealing seat. In the exemplary embodiment, fuel injector 1 is an inwardly opening fuel injector 1, which has a spray-discharge orifice 7.

Nozzle body 2 is connected to an outer pole 9 of a magnetic coil 10 by a welding seam 8. Magnetic coil 10 is wound on a coil brace 12, which rests against an inner pole 13 at magnetic coil 10. Magnetic coil 10 is energized via an electric line (not shown further) by an electric current, which may be supplied via an electrical plug contact 17. A plastic coating 18, which may be extruded onto inner pole 13, encloses plug contact 17.

Valve needle 3, via a flange 14 which is inserted into the tubularly designed valve needle 3 and connected to valve needle 3 by a welding seam 15, is connected to an armature 20 in a force-locking manner. Flange 14 reaches through armature 20 through an opening 19 of armature 20. A restoring spring 23, which in the present design of fuel injector 1 is prestressed by a sleeve 31, is supported on flange 14.

According to the present invention, at least one radially extending fuel channel 11 is formed in flange 14 on the inflow-side of armature 20, the fuel channel allowing the fuel to pass into valve needle 3 upon opening of fuel injector 1. In the closed state of fuel injector 1, the at least one fuel channel 11 is closed off by a shoulder 24 of inner pole 13 from an inner chamber 29 of fuel injector 1, which is formed in inner pole 13 of fuel injector 1.

The fuel is supplied to fuel injector 1 via a central fuel feed 16 and filtered by a filter element 25. A seal 28 seals fuel injector 1 from a distributor line (not shown further).

In the rest state of fuel injector 1, illustrated in FIG. 1A, restoring spring 23 acts upon flange 14 in such a way that it comes to rest against an end face 30 on the inflow side of armature 20. In this way, armature 20 is likewise acted upon by a restoring spring 23, so that valve-closure member 4 formed at valve needle 3 is sealingly held at valve-seat surface 6. A working gap 27, formed between end face 30 of armature 20 and inner pole 13, is opened.

In the closed state of fuel injector 1, the at least one fuel channel 11, which is formed in flange 14, is covered by shoulder 24 of inner pole 13, in such a way that no fuel is able to flow through fuel channel 11. The further functioning of fuel injector 1 during the opening process is explained in greater detail in FIG. 1B.

In a part-sectional, schematic representation, FIG. 1B shows a longitudinal section through the exemplary embodiment of a fuel injector 1, designed according to the present invention as shown in FIG. 1A, in the open state. Identical components have been provided with the same reference numerals in FIGS. 1A and 1B.

FIG. 1B shows the fuel injector 1 designed according to the present invention in the open state. Fuel channel 11 formed in flange 14 connects inner chamber 29 of fuel injector 1 to opening 22 of valve needle 3, so that fuel, which is supplied via central fuel supply 16 and filtered by filter element 25, is able to be guided to the sealing seat via axial bore 21 of flange 14 and opening 22 of valve needle 3. Valve needle 3 has a plurality of flow-through orifices 26 through which the fuel discharges from opening 22 of valve needle 3.

When magnetic coil 10 is energized by means of the electric line (not shown further), a magnetic field is built up which pulls armature 20 to inner pole 13, counter to the force of restoring spring 23, thereby closing working gap 27 between end face 30 on the inflow-side of armature 20 and inner pole 13.

Since flange 14 penetrates armature 20 through its opening 19, flange 14 with armature 20 is moved in the lift direction upon actuation of fuel injector 1, thereby moving valve needle 3, which is frictionally connected to flange 14 via welding seam 15, in the lift direction as well. At the same time, the at least one fuel channel 11 is unblocked. This allows fuel, supplied via central fuel supply 16 via inner chamber 29 of fuel injector 1, to flow through the at least one fuel channel 11 into opening 22 of valve needle 3. The fuel then reaches the sealing seat via flow-through orifices 26 and is spray-discharged into the combustion chamber (not shown further) via spray-discharge orifice 7.

When the coil current is switched off, armature 20, due to the pressure of restoring spring 23, falls away from inner pole 13 after the magnetic field has decayed sufficiently, whereupon valve needle 3, which is in operative connection to flange 14, moves in a direction counter to the lift direction. As a result, valve closure member 4 comes to rest on valve-seat surface 6, and fuel injector 1 is closed. Armature 20 comes to rest against the armature stop formed by second flange 31.

Figure 2:
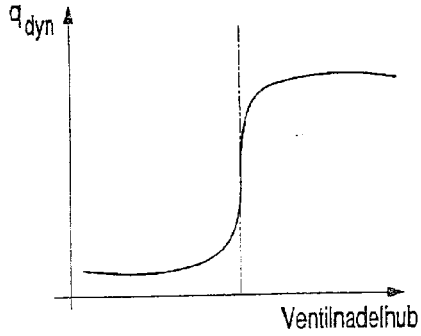
FIG. 2 shows a schematic representation of the dynamic flow rate $q_{dyn}$ as a function of the valve needle lift of the fuel injector according to the present invention, as represented in FIGS. 1A and 1B.

FIG. 2 shows a schematic representation of flow-rate quantity $q_{dyn}$ flowing through fuel injector 1 as a function of the lift of valve needle 3 of fuel injector 1.

By the afore-described arrangement of at least one fuel channel 11, it is possible to set, or model, a characteristic curve representing the dynamic flow rate $q_{dyn}$ of fuel through fuel injector 1 as a function of a lift of valve needle 3. By an appropriate lift adjustment of valve needle 3, as much fuel will flow through fuel injector 1 as is required to obtain the necessary flow-rate precision.

By shoulder 24 covering the at least one fuel channel 11, no fuel is able to flow to the sealing seat at the beginning of the opening process. Only when the at least one fuel channel 11 is released, will the dynamic flow rate $q_{dyn}$ rise quickly and in an approximately step-by-step manner, to a saturation value, as illustrated in FIG. 2.

The described measures are able to improve the dynamics of fuel injector 1 and to lower the production cost, since the design of an armature free path is omitted and the minimal fuel quantity flowing through fuel injector 1 is able to be minimized.

The at least one fuel channel 11 is dimensioned such that it will not act as a throttle, but, upon release, will allow an unthrottled fuel flow through fuel injector 1.

The present invention is not limited to the exemplary embodiments shown and is also applicable, for instance, to fuel injectors 1 of mixture-compressing, self-ignitable internal combustion engines.

What is claimed is:

1. A fuel injector, comprising:

a restoring spring;

a valve needle;

an armature acted upon by the restoring spring, the armature forming an axially movable valve part together with the valve needle;

a magnetic coil that cooperates with the armature;

a valve seat member;

a valve-closure member provided at the valve needle and forming a sealing seat with the valve-seat member; and a flange, wherein:

the flange penetrates the armature through an opening of the armature and is connected to the valve needle by force-locking, and the flange includes at least one radial fuel channel by which an inner chamber of the fuel injector is able to be connected to a recess of the valve needle upon an actuation of the fuel injector.

2. The fuel injector as recited in claim 1, wherein:

in a closed state of the fuel injector, the inner chamber is sealed from the recess.

3. The fuel injector as recited in claim 1, wherein:

in an open state of the fuel injector, the inner chamber is connected to the recess.

4. The fuel injector as recited in claim 1, wherein:

the flange is inserted by a discharge-side end thereof into the recess.

5. The fuel injector as recited in claim 4, wherein:

the flange is supported at an inflow-side end face of the armature.

6. The fuel injector as recited in claim 4, wherein:

the restoring spring is braced against an inflow-side of the flange.

7. The fuel injector as recited in claim 6, wherein:

the restoring spring acts upon the valve needle in a closing direction via the armature and the flange.

8. The fuel injector as recited in claim 1, further comprising:

an inner pole including a shoulder, wherein:

in a closed position, the at least one radial fuel channel is covered by the shoulder.

9. The fuel injector as recited in claim 8, wherein:

the shoulder is designed in one piece with the inner pole.

10. The fuel injector as recited in claim 1, wherein:

the at least one radial fuel channel is dimensioned such that a fuel flows to the sealing seat in an unthrottled manner.

11. The fuel injector as recited in claim 1, wherein:

the valve needle is tubular and includes a plurality of flow-through orifices.

* * * * *

UNITED STATES PATENT AND TRADEMARK OFFICE

CERTIFICATE OF CORRECTION

PATENT NO. : 6,910,643 B2
DATED : June 28, 2005
INVENTOR(S) : Gunter Dantes et al.

It is certified that error appears in the above-identified patent and that said Letters Patent is hereby corrected as shown below:

Title page,
Item [57], ABSTRACT,
Line 1, delete "(1)"; and change "a magnetic coil (10)," to -- a magnetic coil, --.
Line 2, delete "(20)".
Line 3, change "restoring spring (23)," to -- restoring sping, --.
Line 4, change "valve needle (3)." to -- valve needle. --.
Line 5, change "closure member (4)," to -- closure member, --.
Line 6, change "valve-seat member (5)," to -- valve-seat member, --; and "valve-needle (3)." to -- valve needle. --.
Line 7, change "A flange (14)" to -- A flange --; and delete "(20)".
Line 8, delete "(19) (20)".
Line 9, delete "(3)".
Line 10, delete "(11) (29)".
Line 11, delete "(1) (22)".
Line 12, delete "(3)"; and change "fuel injector (1)." to -- fuel injector. --.

Signed and Sealed this

Thirtieth Day of May, 2006

JON W. DUDAS
*Director of the United States Patent and Trademark Office*